US008966727B1

(12) United States Patent
Green et al.

(10) Patent No.: US 8,966,727 B1
(45) Date of Patent: Mar. 3, 2015

(54) CONTAMINATED HUMAN REMAINS POUCH

(71) Applicant: The United States of America, Represented by the Secretary of the Army, Natick, MA (US)

(72) Inventors: Dustin T. Green, Stafford, VA (US); Gregory Gudejko, Natick, MA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/305,056

(22) Filed: Jun. 16, 2014

(51) Int. Cl.
*A61G 1/00* (2006.01)
*A61G 17/06* (2006.01)
*A61G 17/007* (2006.01)

(52) U.S. Cl.
CPC ..... *A61G 17/06* (2013.01); *A61G 17/007* (2013.01)
USPC ..... 27/28; 383/88

(58) Field of Classification Search
CPC ..... A61G 17/06; A61G 7/1055; B31B 19/64; B65B 7/18; B65B 7/20; B65D 31/00; B65D 33/1658; B65D 33/22; A45F 4/08
USPC ..... 27/28; 383/4, 66, 71, 85, 88; 493/186, 493/189, 243; 224/157, 158
See application file for complete search history.

(56) References Cited

U.S. PATENT DOCUMENTS 5,659,933 A * 8/1997 McWilliams ..... 27/28
6,004,034 A 12/1999 Salam
7,228,603 B2 * 6/2007 Craig ..... 27/28
7,337,511 B2 3/2008 Yu et al.
7,484,275 B2 2/2009 Carroll et al.
7,496,995 B2 3/2009 Rosario et al.
8,146,217 B2 4/2012 Jensen et al.
2010/0008601 A1 * 1/2010 Prudencio ..... 383/4
2010/0263178 A1 * 10/2010 Jensen et al. ..... 27/28
2011/0162178 A1 7/2011 Jensen et al.
2013/0174392 A1 * 7/2013 Chua et al. ..... 27/28
2013/0195383 A1 * 8/2013 Daugs, Jr. ..... 383/12

OTHER PUBLICATIONS

ISOVAC Products LLC; CBAG Model 2005CB-PUR; Contaminated Humans Remain Pouch (CHRP); Fact Sheet; 2012.

* cited by examiner

*Primary Examiner* — William Miller
(74) *Attorney, Agent, or Firm* — Roger C Phillips

(57) ABSTRACT

A contaminated human remains pouch includes a sheet of material that is resistant to chemical and biological agents having a substantially rectangular shape having a first long side, a second long side, a first short side and second short side. Complimentary securing elements are fixed along an edge of the first long side and along an edge of the second long side. A folded portion in each corner of the material forms a first seam between adjacent portions of the first short side and a second seam between adjacent portions of the second short side. The complimentary securing elements on the edge of the first long side and the edge of the second long side define an opening when the folder portion in each corner is folded over, and the complimentary securing elements are configured to be mated together to substantially seal the contaminated human remains pouch from cross-contamination.

11 Claims, 5 Drawing Sheets

CONTAMINATED HUMAN REMAINS POUCH

STATEMENT OF GOVERNMENT INTEREST

The invention described herein may be manufactured and used by or for the U.S. Government for governmental purposes without the payment of any royalties thereon or therefor.

FIELD

The aspects of the present disclosure relate generally to the field of human remains recovery and containment systems, and in particular to a contaminated human remains pouch.

BACKGROUND

There are many challenges associated with the collection and transportation of human remains that have been contaminated with one or more of chemical and biological agents, or other toxic materials. It is important to be able to prevent the spread of the agent(s) from the contaminated remains. Most commercial human remains pouches (body bags) are not made of or do not include materials or closure mechanisms that are capable of containing or resisting chemical agent permeation. Also, traditional body bag shapes require the use of darting and other difficult manufacturing techniques that introduce complexity and possible leak paths to and from the body bag or pouch.

Accordingly, it would be desirable to provide a human remains pouch that addresses at least some of the problems identified above.

BRIEF DESCRIPTION OF THE DISCLOSED EMBODIMENTS

As described herein, the exemplary embodiments overcome one or more of the above or other disadvantages known in the art.

One aspect of the exemplary embodiments relates to a contaminated human remains pouch. In one embodiment, the contaminated human remains pouch includes a sheet of material that is resistant to chemical and biological agents having a substantially rectangular shape having a first long side, a second long side, a first short side and second short side. Complimentary securing elements are fixed along an edge of the first long side and along an edge of the second long side. A folded portion in each corner of the material forms a first seam between adjacent portions of the first short side and a second seam between adjacent portions of the second short side. The complimentary securing elements on the edge of the first long side and the edge of the second long side define an opening when the folder portion in each corner is folded over, and the complimentary securing elements are configured to be mated together to substantially seal the contaminated human remains pouch from cross-contamination.

Another aspect of the disclosed embodiments is directed to a method for forming a contaminated human remains pouch. In one embodiment, the method includes forming a sheet of material that is resistant to chemical and biological agents, the sheet of material being substantially rectangular in shape; heat sealing complimentary halves of a securing element to both long sides of the sheet of material; folding each corner of the sheet of material along a fold line, wherein the fold line in each corner has an origin along a central axis of the sheet of material on a short side of the sheet of material; heat sealing a seam formed by adjacent portions of the short side of the sheet of material; and wherein the complimentary halves of the securing element define an opening.

These and other aspects and advantages of the exemplary embodiments will become apparent from the following detailed description considered in conjunction with the accompanying drawings. It is to be understood, however, that the drawings are designed solely for purposes of illustration and not as a definition of the limits of the invention, for which reference should be made to the appended claims. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

BRIEF DESCRIPTION OF THE DRAWINGS

The accompanying drawings illustrate presently preferred embodiments of the present disclosure, and together with the general description given above and the detailed description given below, serve to explain the principles of the present disclosure. As shown throughout the drawings, like reference numerals designate like or corresponding parts.

DETAILED DESCRIPTION OF THE EXEMPLARY EMBODIMENTS OF THE DISCLOSURE

Figure 1:
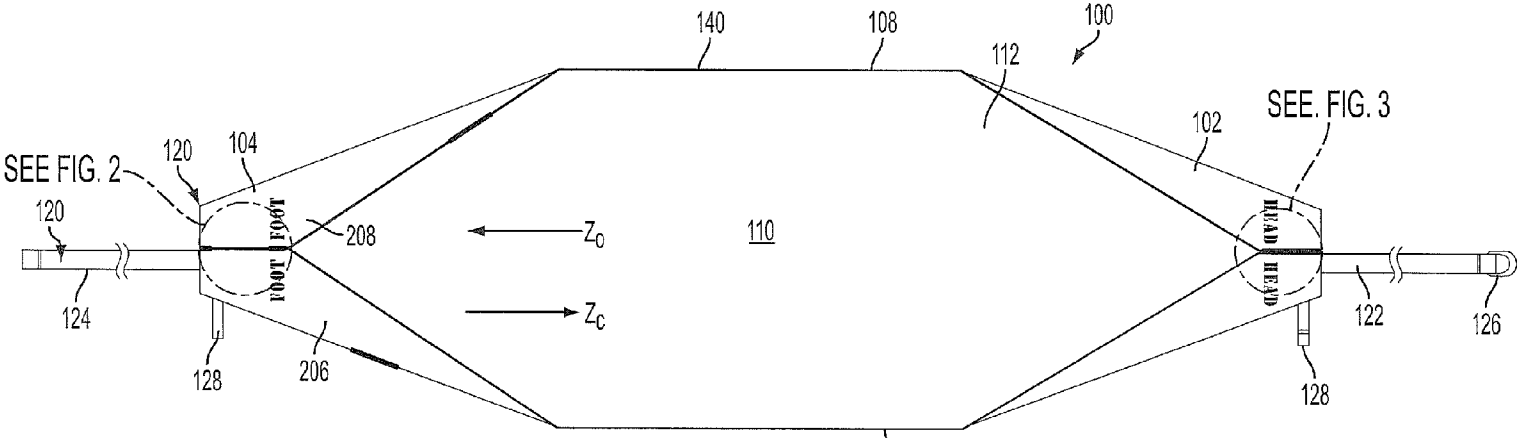
FIG. 1 illustrates a top plan of one embodiment of a contaminated human remains pouch incorporating aspects of the present disclosure.

Referring to FIG. 1, one embodiment of a contaminated human remains recovery and containment system incorporating aspects of the present disclosure is generally designated by reference numeral 100. For the purposes of the disclosure herein, the human remains recovery and containment system will generally be referred to as a body bag or a pouch. The aspects of the disclosed embodiments provide a recovery and containment system for human remains that will protect the recovery, transport and processing personnel from the hazards associated with human remains that are potentially contaminated with agents. Examples of these agents can include, but are not limited to, biological, chemical, radiological, or other toxic materials, or where there is the risk of pathogen infection or dissemination.

The contaminated human remains pouch ("CHRP") 100 of the disclosed embodiments can be employed in the battle space environment to protect soldiers and other personnel from the hazards posed by contaminated human remains from the point of recovery, during transport and during temporary storage. Although the aspects of the disclosed embodiments will generally be described herein in conjunction with military environments, the aspects of the disclosed embodiments are not so limited. In alternate embodiments, the CHRP 100 of the disclosed embodiments can be deployed in any environment where there is a need to protect personnel, such as emergency service personnel, from contamination by remains, such as human or even animal remains, that are contaminated with chemical or biological agents.

Additionally, although the agents described herein will generally be described as chemical or biological agents, in alternate embodiments, that aspects of the present disclosure can be used to prevent the spread of any agent where the particle or molecule size of the agent is greater than that of chemical and biological agent molecules. For example, in one embodiment, the aspects of the present disclosure can be used to prevent the spread of radioactive particles.

FIG. 1 illustrates a top plan view of one example of a CHRP 100 incorporating aspects of the disclosed embodiments. The CHRP 100 of the present disclosure is a flexible, three-dimensional, man-made body bag or pouch. In the example of FIG. 1, the CHRP 100 has two end portions, generally referred to herein as a head portion 102 and a foot portion 104. The terms head and foot are merely descriptive and not necessarily intended to impart any required body positioning or orientation in or on the CHRP 100. The CHRP 100 will also be described herein as having a right side 106 and a left side 108. An opening 110 is defined between the head and foot portions 102, 104 and the right and left side 106, 108. The CHRP 100 also includes an underside or bottom portion 112.

As will be described further herein, the aspects of the disclosed embodiments allow for placing the human remains onto the bottom portion 112 of the CHRP 100 within area generally circumscribed by the opening 110. The right side 106 and the left side 108 are then joined together as will described herein to substantially seal the CHRP 100 and prevent contaminated particles in the form of chemical and biological agents from escaping the CHRP 100.

As shown in FIG. 1, in one embodiment, the CHRP 100 is formed of a sheet 130 of material 140. The material 140 of the CHRP 100 provides protection from chemical, biological and, in some cases radiological particulate (CBR), cross-contamination from the human remains to personnel and other assets. In the examples provided herein, the material 140 is configured to be resistant to chemical and biological agents. Examples of such materials can include, but are not limited to, Saranex polyethylene and KEVLAR™ covered in TEFLON™. ("X-22 Fabric"). In alternate embodiments, any suitable material can be used that is resistant to chemical, biological and radiological agents, as is generally described herein.

In one embodiment, the sheet 130 of material 140 is formed by heat welding two or more pieces of material 140 together to reach the desired size. For example, two pieces of material 140 can be heat welded together to form a single sheet 130 of material 140. In a typical configuration, the material 140 is manufactured in a roller form. A width of the roll can be approximately 59 inches (1498 mm). Pieces from the roll can be heat sealed together and then cut to a desired dimension.

A thickness of the sheet 130 of material 140 can in part, depend upon the type of material used. When the material 140 comprises Saranex, an exemplary thickness of the sheet 130 can be approximately 2 millimeters (0.08 inches). In alternate embodiment, the thickness of the sheet 130 can be any suitable thickness that provides the chemical and biological resistance performance that is generally described herein. In one embodiment, the thickness of the sheet 130 is in the range of approximately 1.5 millimeters (0.06 inches) to and including approximately 4.5 millimeters (0.18 inches).

Contrary to more complex and sophisticated designs of the prior art, the CHRP 100 of the disclosed embodiments provides a lightweight and disposable body bag that is less expensive and relatively easy to fabricate and manufacture. The CHRP 100 is generally portable and disposable, and is typically configured to retain the human remains for a period of about two to three days. Although the aspects of the present disclosure will be generally described herein with respect to human remains, it will be understood that any suitable sized and type of remains can be accommodated in the CHRP 100 of the disclosed embodiments.

As shown in the embodiment illustrated in FIG. 1, the CHRP 100 is configured to be substantially sealed with no leak points. The opening 110 is configured to be sealed by complimentary mating elements on the right side 106 and the left side 108 of the CHRP 100. Once the opening 110 is closed, the CHRP 100 is substantially sealed or leak-proof. The terms "sealed" and "leak-proof" are generally used herein to describe the ability of the CHRP 100 to contain physical particles in the air within the CHRP 100, where the physical particles are those associated with chemical and biological agents. As noted above, in some cases the particles can include radioactive particles.

Figure 2:
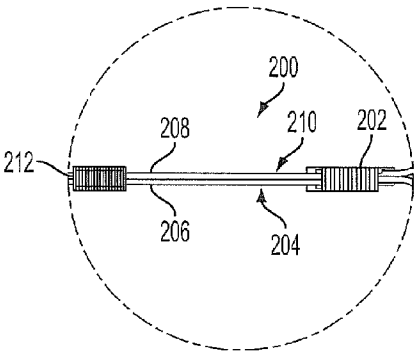
FIG. 2 illustrates a detail view of one embodiment of a closure mechanism for the contaminated human remains pouch shown in FIG. 1.

Referring to FIGS. 1 and 2, in one embodiment, a securing element or closure device 200 is used to join the right side 106 and the left side 108 together. For the purposes of the disclosure herein, the closure device 200 will be described as a "zipper" or having a zipper-like function. In one embodiment, the closure device 200 is an ULTRASEAL™ or ZIPLOC™ type of closure device, providing a sealing function as is generally known. A more detailed view of the closure device 200 is illustrated in FIG. 2 (Detail A of FIG. 1) and FIG. 3 (Detail B of FIG. 1).

As shown in FIG. 2 in one embodiment, the closure device 200 includes a zipper glide portion 202 and a track portion 204. The zipper glide portion 202 is generally configured to travel or be moved along the track portion 204 in one or more of the directions indicated by arrows $Z_O$ and $Z_C$ of FIG. 1. For the purposes of the disclosure herein, the track portion 204 will be described as having complimentary halves or mating elements 206, 208. For the purposes of the disclosure herein, the exemplary mating elements 206, 208 will be referred to as a right track or glide portion 206 and a left track or glide portion 208.

In one embodiment, the track portion 204 of the closure device 200 is formed from a plastic material that is configured to be heat welded to the sheet 130 of material 140 of the CHRP 100. In alternate embodiments, the track portion 204 of the closure device 200 can be attached to the material 140 in any suitable manner including sealing or sonic welding, for example. The aspects of the disclosed embodiments allow for the track portion 204 of the closure device 200 to be mated with the material 140 without stitching, which could otherwise result in potential holes or leak points from which cross-contamination of chemical, biological and radiological particulate from human remains to personnel and other assets might be realized.

In the example of FIGS. 1 and 2, the track portion 204 extends substantially from one end of the CHRP 100 to the other end, or from the head portion 102 to the foot portion 104. As the zipper glide 202 is moved in the direction indicated by arrow $Z_C$, the complimentary halves or glide portions 206, 208 are drawn together to form a seal 210. The seal 210 is configured to be substantially resistant to the passage of chemical and biological agents as is described herein. Although the zipper glide 202 is described as being used to draw the glide portions 206, 208 together to form the seal 210, in one embodiment, the glide portions 206, 208 can be mated together in any suitable fashion, such as by pressing the two portions 206, 208 together.

Figure 3:
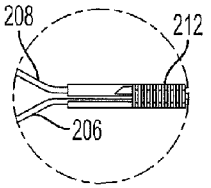
FIG. 3 illustrates a detail view of one embodiment of an end stop for the closure mechanism shown in FIG. 2.

In one embodiment, referring to FIG. 2 and FIG. 3, the head portion 102 and the foot portion 104 of the CHRP 100 includes an end stop 212, 214, respectively. The end stops 212 and 214 will be generally understood to include features commonly associated with a glide zipper. Although the closure device 200 is generally described herein as an ULTRASEAL™ or ZIPLOC™ type device, in alternate embodiments, any suitable device can be used that will allow the CHRP 100 to be closed and seal in a manner that prevents any chemical, biological or radiological particles or agents from escaping through the seal. In one embodiment, end stops 212, 214 are glued or otherwise secured in place.

Referring again to FIG. 1, the CHRP 100 of the disclosed embodiments can include one or more belt or strap members 120, also referred to herein as a tightening strap. In the example of FIG. 1, a portion 122 of the strap member 120 extends from the head portion 102, while a portion 124 of the strap member 120 extends from the foot portion 104. The strap member 120 is generally used to secure the CHRP 100 and can also be used for transport, as is shown for example in FIG. 4. Although the strap member 120 is generally described herein as a single piece member, such as shown in FIG. 5, in alternate embodiments, the strap member 120 can be comprised of two or more members, such as one for the head portion 102 and another for the foot portion 104.

Figure 4:
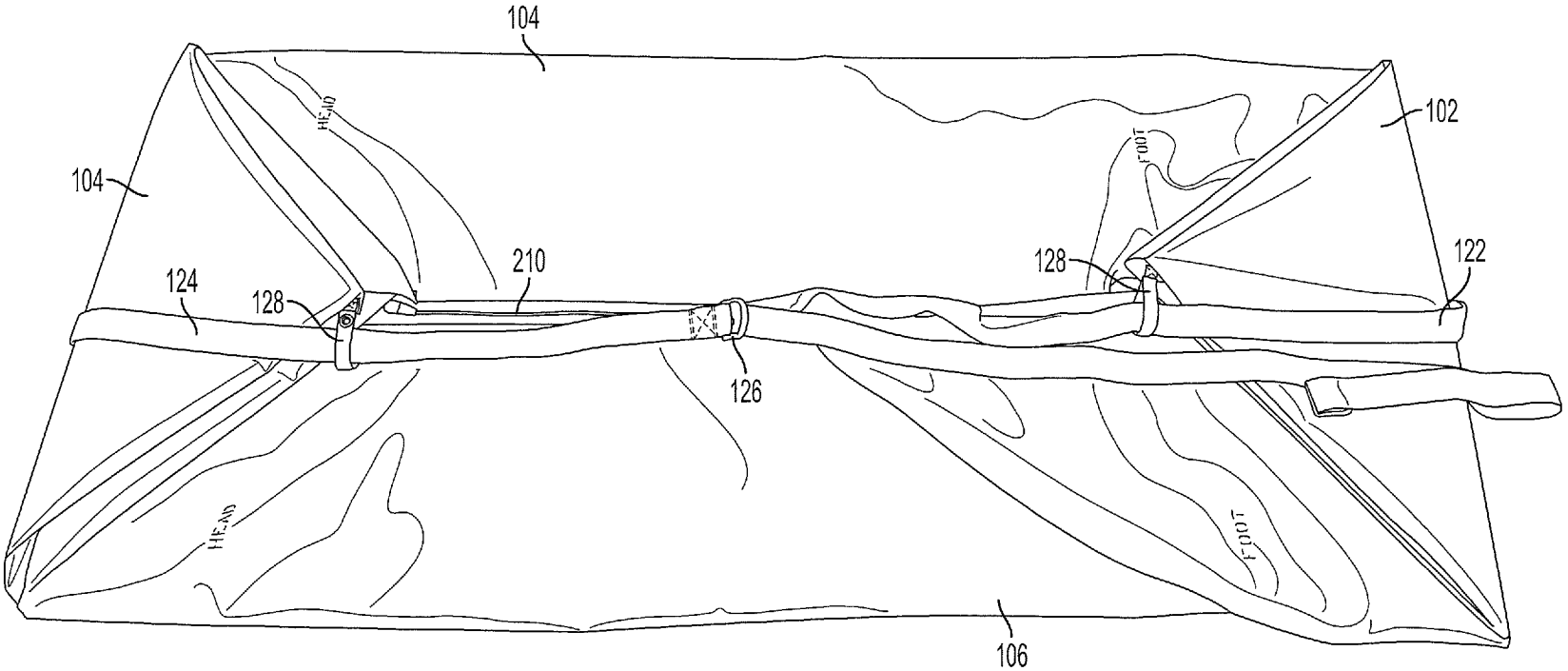
FIG. 4 is a top perspective view of one embodiment of a contaminated human remains pouch incorporating aspects of the present disclosure.
Figure 5:
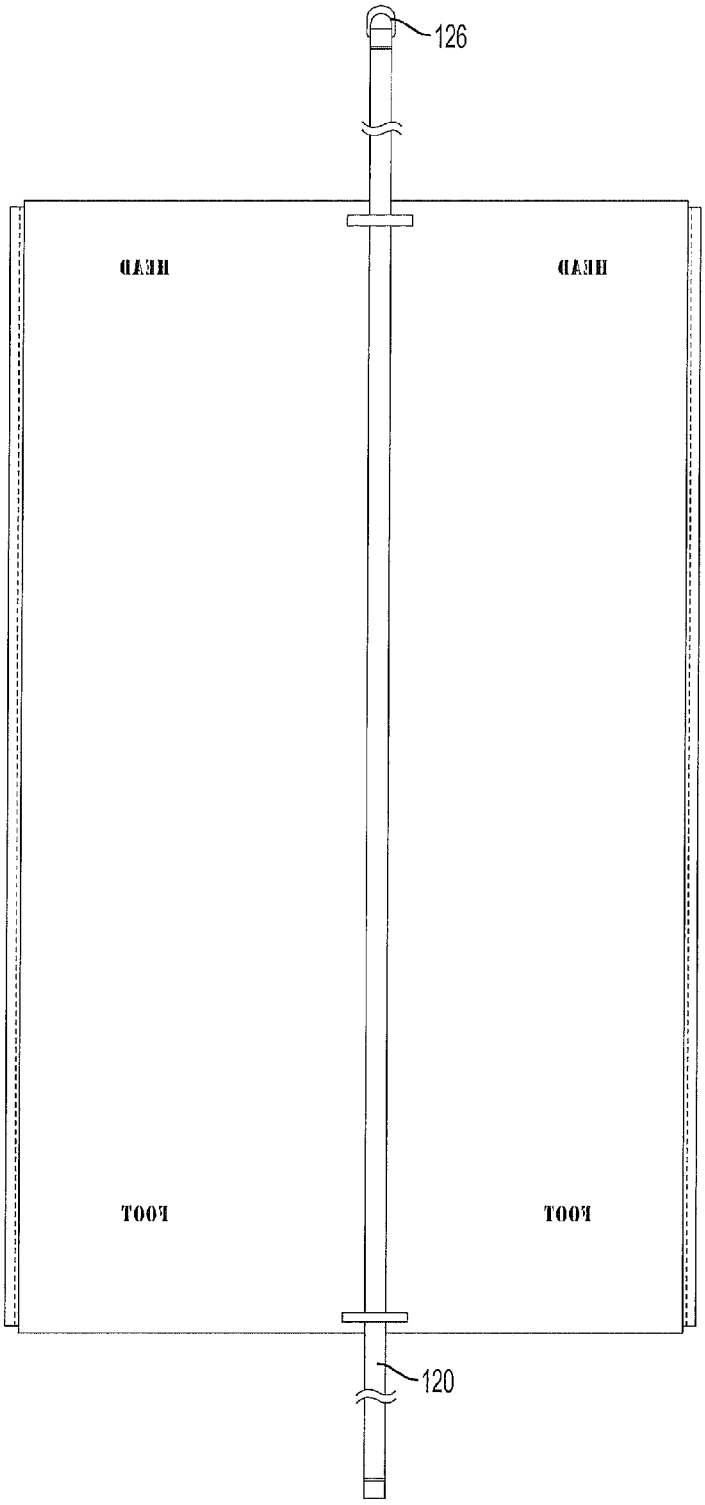
FIG. 5 illustrates a plan view of a bottom side of one embodiment of a contaminated human remains pouch incorporating aspects of the present disclosure.

In one embodiment, referring to FIGS. 1 and 4, the strap member 120 can include a buckle or other securing device 126 that allows for the two ends of the strap member 120 to be joined together. In the embodiment shown in FIG. 1, the securing device 126 is a D-ring, as is generally known. In alternate embodiments, and suitable strap or belt securing device can be used to secure the portions 122 and 124 of the strap member 120 together.

The CHRP 100 can also include one more loop members 128. In the example of FIG. 1, the loop members 128 are used to retain or secure the strap member 120, and in particular one or more of the portions 122, 124, in place. In one embodiment, the loop member 128 is a piece of webbing type material that includes a snap or other closure device. The loop member 128 can be opened and closed.

Figure 6:
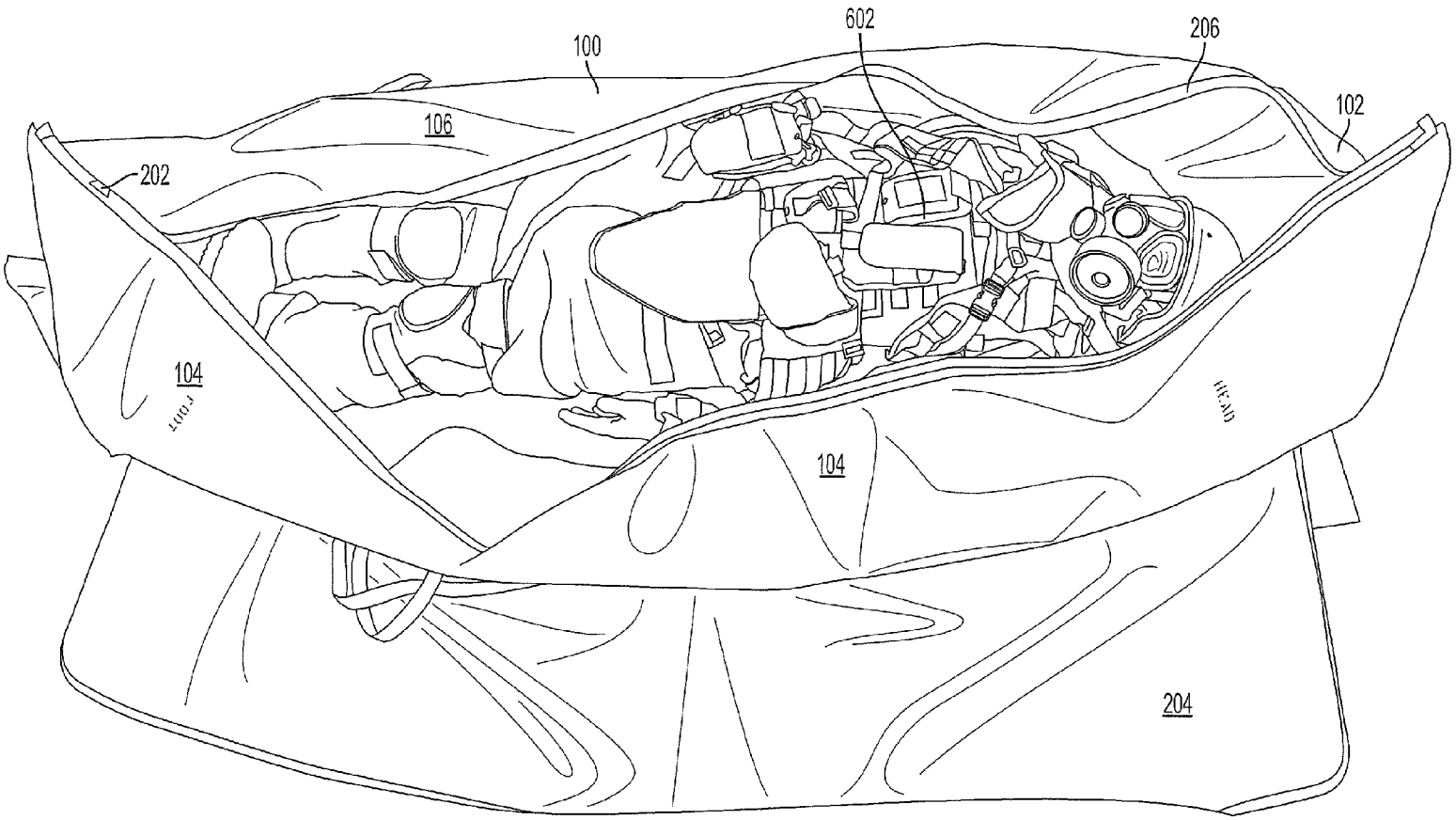
FIG. 6 illustrates a top perspective view of contaminated human remains pouch incorporating aspects of the present disclosure.

In operation, referring to FIG. 6, the CHRP 100 is generally configured to hold human remains, and in particular, contaminated human remains. The CHRP 100 is positioned adjacent the contaminated human remains (CHR) 602. In this example, the head portion 102 of the CHRP 100 is aligned with the head of the CHR 602. As shown in FIG. 6, the zipper glide 202 is moved to open the closure device 200 of the CHRP 100 and provide the opening 110.

As illustrated in FIGS. 1 and 6, in an open state, the CHRP 100 generally provides an opening 110, generally described herein as a substantially box-shaped opening. The term "box-shaped" is generally intended to mean having a squarish or rectangular geometric configuration. Although a box-shaped opening 110 is shown in FIG. 1, the opening 110 can be any suitable shaped, other than including a box.

The CHR 602 can then be rolled or otherwise positioned within the opening 110. Each side 106, 108 of the CHRP 100 is then pulled upwards along either side of the CHR 602. The zipper style closure device 200 is then closed to seal the CHRP 100. The head and foot portions 122, 124 of the strap 120 are joined together and tightened. This pulls the head portion 102 and the foot portion 104 of the CHRP 100 towards a middle of the CHRP 100. In one embodiment, the head portion 102 and the foot portion 104 are folder over each end of the CHRP 100. Alternatively, the head and foot portions 102, 104 can be tucked in, and otherwise secured using for example, any one or more of the strap and loop members 120 and 128.

Figure 8:
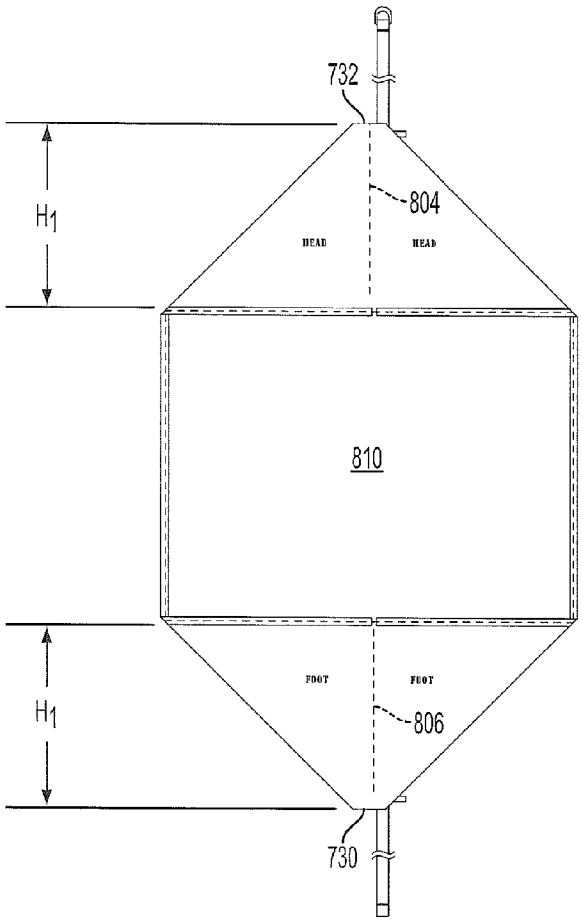
FIGS. 7-8 illustrate a plan view of a sheet of material for the formation of a contaminated human remains pouch incorporating aspects of the present disclosure.
Figure 7:
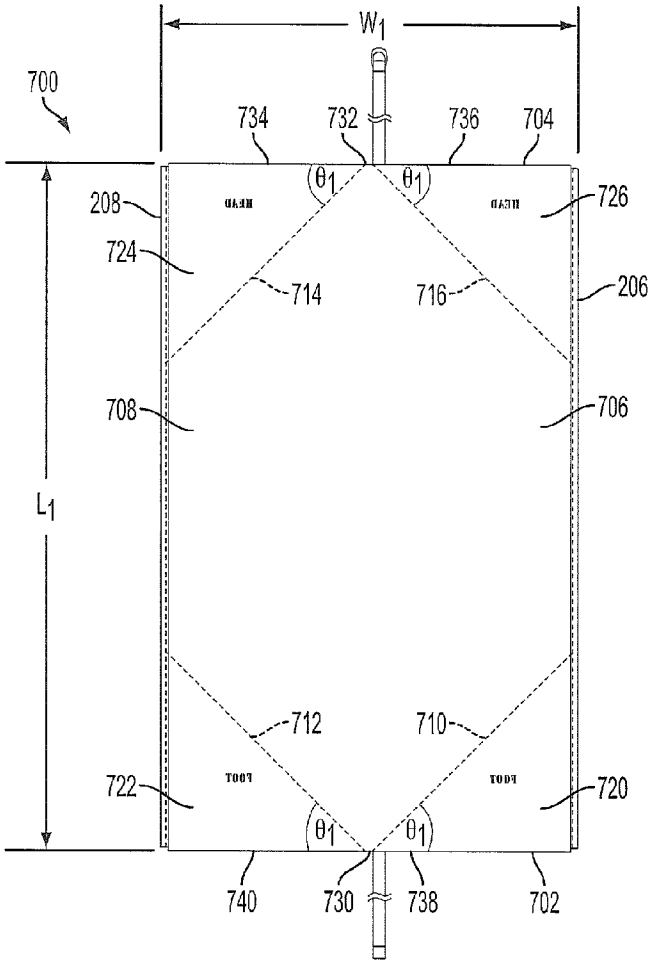

FIGS. 7 and 8 illustrate one embodiment of the formation of a CHRP 100. In this embodiment, a squared off piece 700 of material 140 that will be used to form the CHRP 100 is prepared. The shape of the piece 700 of the material 140 is substantially rectangular and will include an opposing pair of long sides 706, 708 and an opposing pair of short sides 702, 704. An exemplary set of dimensions for the piece 700 of the material 140 shown in FIG. 7 is approximately 120 inches (3048 millimeters)×78 inches (1981.2 millimeters). In alternate embodiments, the dimensions of the piece 700 of the material 140 can be any suitable size. For example, in the embodiment of FIG. 8, the length L1 is approximately 120 inches (3048 millimeters), and the width W1 is approximately 70 inches (1778 millimeters). The height H1 shown in FIG. 8 is approximately 33.75 inches (857.25 millimeters). In alternate embodiments, the width W1 can be in the range of approximately 70 inches (1778 millimeters) to and including approximately 86 inches (2184.4 millimeters).

Once the piece 700 of material 140 is squared off, the right and left tracks 206, 208 of the closure device 200 are attached or otherwise sealed to the corresponding long sides 706, 708 of the piece 700. As shown in this example, right track 206 is attached to the right long side 706, while the left track 208 is attached to the left long side 708.

Once the right and left tracks 206, 208 of the closure device 200 are attached to the long sides 706, 708 of the piece 700, the short sides 702, 704 of the piece 700 need to be sealed together. In the example of FIG. 7, fold lines 710-716 are formed. As shown in FIG. 7, in one embodiment, the respective fold line 710-716 has an origin on the short side of the sheet 700, generally at a point corresponding to a central axis of the sheet. The fold lines 710-716 extend at an angle $\theta_1$ of approximately 45 degrees, until they intersect with a corresponding long side 706, 708. The portions 720-726 are each folded over the corresponding fold line 710-716. In one embodiment, at the ends 730, 732, a cut is made approximately ⅞ inches in from the end. The joined edges 734, 736 and 738, 740, form seams 802, 804 shown in FIG. 8, which, along with the bottom ends 730, 732 are then sealed. In one embodiment, the seams 802, 804 and ends 730, 732 are heat sealed or welded. FIG. 8 illustrates one embodiment of the assembly of FIG. 7 in a sealed and folded state. The opening 810 in this example, is not closed.

The aspects of the disclosed embodiments provide a system in the form of a contaminated human remains pouch to contain human remains that have been contaminated with traditional chemical and biological warfare agents. The contaminated human remains pouch of the disclosed embodiments requires only straightforward seams to ease in manufacturing and reduce the probability of leak paths. The larger opening created from the design of the contaminated human remains pouch allows for ease of use when placing fully-clothed remains with protective military gear in the pouch with minimal personnel. This reduces risk of injury to personnel who are retrieving the contaminated remains.

Thus, while there have been shown, described and pointed out, fundamental novel features of the invention as applied to the exemplary embodiments thereof, it will be understood that various omissions and substitutions and changes in the form and details of devices and methods illustrated, and in their operation, may be made by those skilled in the art without departing from the spirit of the invention. Moreover, it is expressly intended that all combinations of those elements and/or method steps, which perform substantially the same function in substantially the same way to achieve the same results, are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A contaminated human remains pouch, comprising:

a single sheet of material that is resistant to chemical and biological agents having a substantially rectangular shape having a first long side, a second long side, a first short side and second short side;

complimentary securing elements fixed along an edge of the first long side and along an edge of the second long side;

a folded portion in each corner of the sheet of material forming a first seam between adjacent portions of the first short side and a second seam between adjacent portions of the second short side;

wherein the complimentary securing elements on the edge of the first long side and the edge of the second long side define an opening when the folded portion in each corner is folded over; and wherein the complimentary securing elements are configured to be mated together to substantially seal the contaminated human remains pouch from cross-contamination.

2. The contaminated human remains pouch of claim 1, wherein the sheet of material is one or more of Saranex polyethylene and KEVLAR™ covered in TEFLON™ ("X-22 Fabric").

3. The contaminated human remains pouch of claim 1, wherein the first seam and the second seam are heat welded.

4. The contaminated human remains pouch of claim 1, wherein the first long side and the second long side are configured to be pulled upwards to allow the complimentary securing elements to mate and seal the opening.

5. The contaminated human remains pouch of claim 1, wherein the complimentary securing elements comprise an ULTRASEAL™ or ZIPLOC™ closure device.

6. The contaminated human remains pouch of claim 1, wherein the complimentary securing elements are heat welded to the sheet of material.

7. A method of forming a contaminated human remains pouch, comprising:

forming a single sheet of material that is resistant to chemical and biological agents, the single sheet of material being substantially rectangular in shape;

heat sealing complimentary halves of a securing element to both long sides of the sheet of material;

folding each corner of the sheet of material along a fold line, wherein the fold line in each corner has an origin along a central axis of the sheet of material on a short side of the sheet of material;

heat sealing a seam formed by adjacent portions of the short side of the sheet of material; and wherein the complimentary halves of the securing element define an opening.

8. The method of claim 7, wherein the sheet of material is one or more of Saranex polyethylene and KEVLAR™ covered in TEFLON™ ("X-22 Fabric").

9. The method of claim 7, wherein the long sides of the sheet of material are configured to be pulled upwards to allow the complimentary halves of the securing element to mate and seal the opening.

10. The method of claim 7, wherein the complimentary halves of the securing element comprise an ULTRASEAL™ or ZIPLOC™ closure device.

11. The method of claim 7, wherein the complimentary halves of the securing element are heat welded to the single sheet of material.

* * * * *